US006920957B2

(12) United States Patent
Usuki et al.

(10) Patent No.: US 6,920,957 B2
(45) Date of Patent: Jul. 26, 2005

(54) LOUDSPEAKER DIAPHRAGM

(75) Inventors: Sawako Usuki, Kobe (JP); Shuji Saiki, Uda-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 114 days.

(21) Appl. No.: 10/600,826

(22) Filed: Jun. 23, 2003

(65) Prior Publication Data

US 2004/0003960 A1 Jan. 8, 2004

(30) Foreign Application Priority Data

Jun. 24, 2002 (JP) ..... 2002-182492

(51) Int. Cl.[7] ..... G10K 13/00; H04R 7/14; H04R 7/02; H04R 11/02; H04R 9/06

(52) U.S. Cl. ..... 181/173; 181/171; 181/172; 181/166; 381/392; 381/423; 381/431

(58) Field of Search ..... 181/171–174, 181/166; 381/392, 386, 423, 202, 405, 424, 429, 431, 203, 205

(56) References Cited

U.S. PATENT DOCUMENTS

| | | | | | |
|---|---|---|---|---|---|
| 1,080,953 | A | * | 12/1913 | Catucci | 181/173 |
| 1,796,335 | A | * | 3/1931 | Lumiere | 181/173 |
| 1,870,417 | A | * | 8/1932 | Mallina | 181/173 |
| 1,990,409 | A | * | 2/1935 | Athol | 181/173 |
| 2,439,665 | A | * | 4/1948 | Marquis | 181/172 |
| 2,531,634 | A | * | 11/1950 | Lawrance | 181/174 |
| 3,829,623 | A | * | 8/1974 | Willis et al. | 381/370 |
| 4,321,434 | A | * | 3/1982 | Irie | 181/173 |
| 4,353,432 | A | * | 10/1982 | Hasegawa et al. | 181/166 |
| 4,433,214 | A | * | 2/1984 | Jasinski | 181/172 |
| 4,471,173 | A | * | 9/1984 | Winey | 381/431 |
| 4,581,496 | A | * | 4/1986 | Sweany | 181/166 |
| 5,003,610 | A | * | 3/1991 | Adachi et al. | 381/431 |
| 5,251,188 | A | * | 10/1993 | Parsons et al. | 181/173 |
| 5,371,805 | A | * | 12/1994 | Saiki et al. | 181/173 |
| 5,664,024 | A | * | 9/1997 | Furuta et al. | 381/396 |
| 5,847,332 | A | * | 12/1998 | Faraone | 181/173 |
| 6,104,825 | A | * | 8/2000 | Thigpen | 381/431 |
| 6,185,310 | B1 | * | 2/2001 | Kermani et al. | 381/431 |
| 6,341,167 | B1 | * | 1/2002 | Okuyama et al. | 381/423 |
| 6,594,372 | B2 | * | 7/2003 | Nakaso | 381/431 |
| 6,611,604 | B1 | * | 8/2003 | Irby et al. | 181/171 |
| 2002/0039430 | A1 | * | 4/2002 | Nakaso | 381/396 |

FOREIGN PATENT DOCUMENTS

| | | | | | |
|---|---|---|---|---|---|
| JP | 58083496 | A | * | 5/1983 | H04R/7/14 |
| JP | 58119296 | A | * | 7/1983 | H04R/9/00 |
| JP | 58137400 | A | * | 8/1983 | H04R/7/18 |
| JP | 58199000 | A | * | 11/1983 | H04R/7/20 |
| JP | 59094995 | A | * | 5/1984 | H04R/7/14 |
| JP | 59152796 | A | * | 8/1984 | H04R/7/02 |
| JP | 60199297 | A | * | 10/1985 | H04R/7/02 |
| JP | 61123390 | A | * | 6/1986 | H04R/7/12 |
| JP | 10-191494 | | | 7/1988 | |
| JP | 63222599 | A | * | 9/1988 | H04R/7/20 |
| JP | 11168794 | A | * | 6/1999 | H04R/9/00 |
| JP | 11168795 | A | * | 6/1999 | H04R/9/00 |
| JP | 2000032586 | A | * | 1/2000 | H04R/9/00 |

* cited by examiner

*Primary Examiner*—Edgardo San Martin
(74) *Attorney, Agent, or Firm*—Wenderoth, Lind & Ponack, L.L.P.

(57) ABSTRACT

A loudspeaker diaphragm affixed with a coil includes an edge portion located outside of a portion affixed with the coil and a center portion located inside of the portion affixed with the coil. The center portion is provided thereon with ribs. With these ribs, the height of the center portion can be limited to the height of the ribs. Therefore, it is possible to save a space of a loudspeaker where the loudspeaker diaphragm is placed, thereby slimming down the loudspeaker. Furthermore, with these ribs, the rigidity of the center portion can be improved without using a conventional solution of forming, for example, a dome shape on the center portion.

30 Claims, 9 Drawing Sheets

LOUDSPEAKER DIAPHRAGM

BACKGROUND OF THE INVENTION

1. Field of the Invention

The present invention relates to loudspeaker diaphragms and, more specifically, to a loudspeaker diaphragm for use in a loudspeaker which is expected to be reduced in thickness.

2. Description of the Background Art

In recent years, electronic devices, such as cellular phones and PDAs (personal digital assistants), have been slimmed down and equipped with a larger screen, while still being expected to produce high-quality sound. Accordingly, loudspeakers incorporated in such electronic devices are similarly expected to be slimmed down and to still produce high-quality sound. To fulfill such expectations, rectangular- or oval-shaped slim loudspeakers have been suggested.

FIGS. 12A and 12B are illustrations showing the structure of a conventional slim loudspeaker. FIG. 12A is a top plan view of the conventional slim loudspeaker, and FIG. 12B is a front elevational view thereof. In FIGS. 12A and 12B, the slim loudspeaker includes a magnet 901, a plate 902, a yoke 903, a housing 904, a cylinder-shaped coil 905, and a diaphragm 906 shaped like an oval. Located on a center portion of the diaphragm 906 (the portion surrounded by the coil 905 affixed to the diaphragm 906) is a dome-shaped portion 911 shaped like a semi-circle in cross section. Furthermore, located at an outer rim of the diaphragm 906 (a portion outside of a dotted line drawn on the diaphragm 906 of FIG. 12A) is an edge portion 912 shaped like a semi-oval in cross section. The edge portion 912 of the diaphragm 906 is supported by the housing 904. Here, the diaphragm 906 is supported so that the coil 905 is inserted in a magnetic gap between the plate 902 and the yoke 903.

In FIGS. 12A and 12B, the coil 905 is shaped like a circle when viewed from above. Therefore, it is difficult for the driving force of the coil to propagate in the direction of the length of the diaphragm 906 (in the horizontal direction in FIG. 12A). To prevent this difficulty, the coil can be shaped like an oval, as is the diaphragm. With this shape, the rigidity of the diaphragm in the direction of the length thereof can be maintained. On the other hand, in order to sufficiently ensure the rigidity of the diaphragm in a direction perpendicular to the direction of the length thereof, the center portion of the diaphragm is strengthened by shaping the center portion like a dome, as illustrated in FIG. 12B, or by using a voice coil bobbin in the conventional slim loudspeakers.

However, such a dome-like portion or a voice coil bobbin required to strengthen the center portion of the diaphragm disadvantageously increases the height at the center portion. Therefore, there is a limit in the conventional structure to slim down the diaphragm. Moreover, particularly in the case of strengthening the diaphragm by a voice coil bobbin, a vibrating system of the loudspeaker is increased in mass, thereby decreasing pressure sensitivity.

In the conventional structure of the diaphragm shaped like an oval or a rectangle, the elasticity in the vicinity of the center portion of the diaphragm is different from the elasticity in the vicinity of both ends of the width of the diaphragm. Specifically, the elasticity in the vicinity of the center portion is small, while the elasticity in the vicinity of both ends is large. As a result, the diaphragm performs a drum-like motion, in which a larger amplitude is observed at portions closer to the center portion (refer to FIG. 8). That is, it is not possible for the entire diaphragm to perform a piston motion. This causes a problem of degradation in sound pressure frequency characteristics.

SUMMARY OF THE INVENTION

Therefore, an object of the present invention is to provide a loudspeaker diaphragm capable of reducing the thickness of a loudspeaker. Another object of the present invention is provide a loudspeaker diaphragm capable of reproducing high-quality sound even when the diaphragm is shaped like an oval or a rectangle.

The present invention has the following features to attain the objects mentioned above. That is, a first aspect of the present invention is directed to a loudspeaker diaphragm having a portion affixed with a coil (hereinafter simply referred to as a diaphragm). The diaphragm includes an edge portion located outside of the portion affixed with the coil; and a center portion located inside of the portion affixed with the coil. The center portion is provided with a rib.

According to the above, the height of the portion inside of the portion affixed to the coil (the center portion) can be suppressed to the height of the rib. Therefore, it is possible to conserve a space of a loudspeaker where the diaphragm is placed, there by slimming down the loudspeaker. Furthermore, with the rib, the rigidity of the center portion can be improved without using a conventional solution of forming, for example, a dome shaped portion on the center portion. Therefore, according to the diaphragm, the loudspeaker can be slimmed down while maintaining the sound quality.

When the edge portion includes a convex portion having a protruding shape in cross section, the rib has a height lower than a height of the edge portion in cross section.

When the coil is shaped so as to extend along a first direction, a direction in which the rib is provided includes a component of a second direction perpendicular to the first direction. Here, "the coil is shaped so as to extend along a first direction" means that the coil is shaped in a rectangle or an oval, for example, having different lengths in the longitudinal direction and the horizontal direction. That is, the "first direction" means a long-diameter direction (the longitudinal direction in FIG. 1B, for example), which will be described further below, while the "second direction" means a short-diameter direction, which will also be described further below. Here, the rib can be provided so as to extend along the second direction. Alternatively, a plurality of said ribs can be provided to form a lattice shape at a predetermined angle with respect to the first direction.

According to the above, the rib is provided in the direction that includes a component of a direction perpendicular to the longitudinal direction, that is, the second direction. With this, the rigidity of the center portion in the second direction can be improved. Therefore, even if the coil has a shape having different lengths in the longitudinal direction and the horizontal direction when viewed from above, the sound quality can be maintained, and the loudspeaker can be slimmed down.

Furthermore, the rib can be provided on a side of the portion affixed with the coil, and has a height lower than a height of the coil. In this case, the rib does not have an influence at all on the thickness of the diaphragm. Therefore, when designing a loudspeaker, the designer determines the height of the loudspeaker in consideration of only the thickness of the coil and the thickness of the edge portion. Therefore, the loudspeaker can be further slimmed down.

Still further, the rib can be formed integrally with the center portion. Alternatively, the rib can be attached to the center portion. When the rib is integrally formed, the number of components is reduced. Also, since a process of attaching the rib to the center portion is not required, the number of assembling processes is reduced.

A second aspect of the present invention is directed to a diaphragm having a portion affixed with a coil. The diaphragm includes an edge portion located outside of the portion affixed with the coil; and a center portion located inside of the portion affixed with the coil. The center portion is provided with a strengthening portion which is flat in cross section and is thicker than the edge portion. Here, "thicker than the edge portion" means that the thickness of a board forming the center portion is higher than the thickness of a board forming the edge portion (not the thickness of a convex portion provided on the edge portion).

According to the above, as with the first aspect, the rigidity of the center portion can be improved without using a conventional solution of forming, for example, a dome shape on the center portion. Therefore, according to the diaphragm of the second aspect, the loudspeaker can also be slimmed down while maintaining the sound quality.

A third aspect of the present invention is directed to a diaphragm extending along a first direction. Here, a coil is affixed to a portion of the diaphragm and extends along the first direction. The diaphragm includes an edge portion located outside of the portion affixed with the coil; and a center portion located inside of the portion affixed with the coil. The edge portion has a shape so that an elasticity in the first direction is approximately equal to an elasticity in a second direction perpendicular to the first direction.

According to the above, even when the coil has a shape having different lengths in the longitudinal direction and the horizontal direction when viewed from above, the amount of deformation by vibrations at the center portion of the diaphragm can be suppressed. Here, when the coil has the above-described shape, if no rib is provided, the elasticity of the edge portion in the vicinity of the center of the diaphragm is smaller than the elasticity thereof at both ends in the longitudinal direction. As a result, with vibrations, the amount of deformation of the diaphragm is larger at portions closer to the center portion. Such vibrations are totally different from those observed at the ideal piston motion. By contrast, according to the diaphragm of the third aspect, a rib, for example, is provided on a portion of the edge portion that extends in the first direction and is closer to the center portion of the diaphragm (refer to FIG. 7A, which will be described further below). With this, the elasticity of the edge portion at the portion provided with the rib becomes larger, thereby balancing the elasticity of the edge portion between the vicinity of the center portion of the diaphragm and both ends of the edge portion. As a result, vibrations become similar to those observed at the piston motion, thereby improving the sound quality.

Furthermore, the edge portion can include a convex portion having a protruding shape in cross section and annularly surrounding the portion affixed with the coil. At this time, a height of a portion of the convex portion that is oriented in the first direction is made higher than a portion of the convex portion that is oriented in the second direction. With this, the balance in elasticity of the edge portion between the vicinity of the center portion of the diaphragm and both ends of the edge portion can be further improved.

Still further, portions on the edge portion which are located on both sides of the coil with respect to a center axis of the coil in the first direction are each provided with a rib extending approximately in parallel with the second direction.

Still further, in the above first through third aspects, the coil can be a printing voice coil formed integrally with the diaphragm. Also, the loudspeaker diaphragm can be molded after being formed integrally with the coil affixed thereto.

Still further, in the above first through third aspects, at least part of a portion along an outer rim of the coil on the edge portion may protrude from a side of the portion affixed with the coil. With this, the coil can be stably affixed to the diaphragm. Furthermore, when the coil is affixed to the diaphragm with an adhesive, it is possible to prevent the adhesive from flowing toward the edge portion.

Still further, the diaphragm can be provided so as to include the features of the first and third aspects, or the features of the second and third aspects. Still further, the loudspeaker diaphragms according to the first through third aspects can be provided as being incorporated in a loudspeaker. The loudspeaker includes a housing supporting the diaphragm; a voice coil affixed to the diaphragm; and a magnetic circuit. Furthermore, the magnetic circuit can include at least two magnets placed at both sides with respect to a vibrating direction of the diaphragm so as to sandwich the voice coil. Still further, said at least two magnets can be placed so as to be magnetized in directions opposite to each other with respect to a vibrating direction of the loudspeaker diaphragm. Still further, the diaphragms according to the first through third aspects can be provided as being included in an electronic device having the above-described loudspeaker.

These and other objects, features, aspects and advantages of the present invention will become more apparent from the following detailed description of the present invention when taken in conjunction with the accompanying drawings.

DESCRIPTION OF THE PREFERRED EMBODIMENTS (Embodiment 1)

First, a loudspeaker diaphragm (hereinafter simply referred to as "diaphragm") according to Embodiment 1 of the present invention is described below with reference to FIGS. 1A through 1D and FIG. 2. FIGS. 1A through 1D are illustrations showing the structure of the loudspeaker using the diaphragm according to Embodiment 1. FIG. 2 is a graph showing sound pressure frequency characteristics of the loudspeaker using the diaphragm according to Embodiment 1.

Figure 1A:
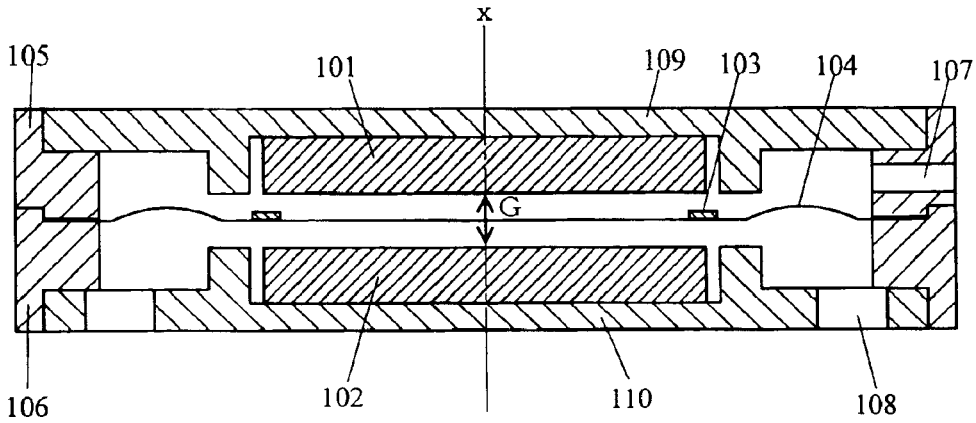
FIGS. 1A through 1D are illustrations showing the structure of a loudspeaker using a diaphragm according to Embodiment 1.
Figure 2:
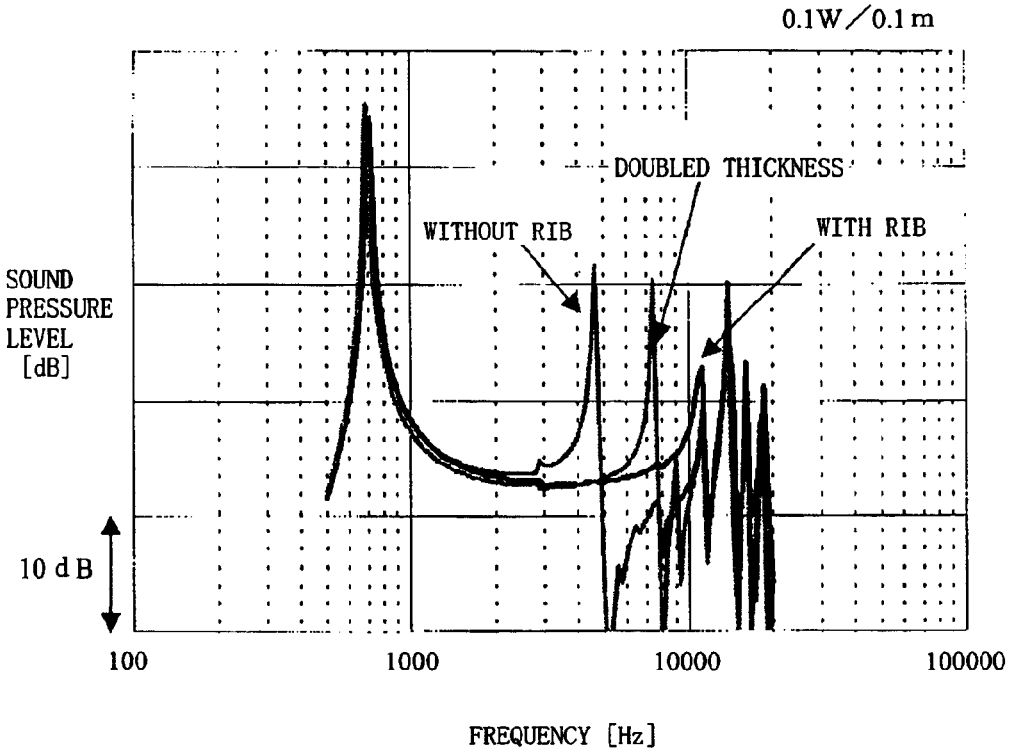
FIG. 2 is a graph showing sound pressure frequency characteristics of the loudspeaker using the diaphragm according to Embodiment 1.

FIG. 1A is a cross section view of the loudspeaker. In FIG. 1A, the loudspeaker includes a first magnet 101, a second magnet 102, a coil 103, a diaphragm 104, a first housing 105, a second housing 106, a first yoke 109, and a second yoke 110. The first housing 105 is provided with a first air hole 107. The second yoke 110 is provided with a second air hole 108. Although not shown, the loudspeaker has an outer shape of a rectangular parallelepiped having a bottom surface shaped in a rectangle whose long side is 3.2 times longer than its short side.

In FIG. 1A, the first and second magnets 101 and 102 are shaped like rectangular parallelepipeds implemented by, for example, neodymium magnets whose energy product is 38MGOe. The first and second magnets 101 and 102 are magnetized in directions opposite to each other with respect to a vibrating direction of the diaphragm 104. For example, if the first magnet 101 is magnetized upwardly (in a direction from the second magnet to the first magnet), the second magnet 102 is magnetized downwardly (in a direction from the first magnet to the second magnet). The first magnet 101 is fixed to the first yoke 109 and the second magnet 102 is fixed to the second yoke 102 so that a symmetry axis x passes through the centers of both first and second magnets 101 and 102. The first yoke 109 is connected at its outer rim portion to the first housing 105, while the second yoke 110 is connected at its outer rim portion to the second housing 106. The first and second yokes 109 and 110 are made of a magnetic material, such as iron. The first and second housings 105 and 106 are made of a non-magnetic material typified by a resin material, such as PC (polycarbonate).

The coil 103 is formed on the diaphragm 104 so that the center of the coil 103 coincides with the centers of the first and second magnets 101 and 102, that is, the symmetry axis x passes through the center of the coil 103. In Embodiment 1, the coil 103 is affixed by an adhesive to the diaphragm 104. An outer rim portion of the diaphragm 104 is fixed between the first and second housings 105 and 106 so that the coil 103 is located equidistant from the first and second magnets 101 and 102. The second air hole 108 is provided on the second yoke 110. The first air hole 107 is provided on one side surface of the first housing 105.

Figure 1B:
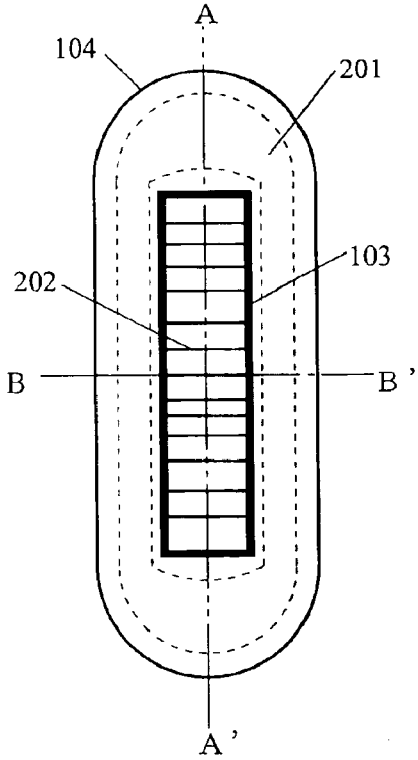

FIG. 1B is a top plan view of the diaphragm 104 and the coil 103 according to Embodiment 1. As illustrated in FIG. 1B, the diaphragm 104 is shaped so as to extend along a predetermined direction (for example, a longitudinal direction in FIG. 1B). That is, the diaphragm 104 has a shape having different lengths in longitudinal and horizontal directions. Hereinafter, the longitudinal direction of the diaphragm 104 is referred to as a long-diameter direction, while a direction perpendicular to the long-diameter direction is referred to as a short-diameter direction.

As described above, the diaphragm 104 is affixed with the coil 103. As with the diaphragm 104, the coil 103 is shaped so as to extend along the longitudinal direction in FIG. 1B. Specifically, the coil 103 is shaped in a rectangle when viewed from above. The diaphragm 104 is composed of an outer portion located outside of a portion affixed with the coil 103 (this outer portion is hereinafter referred to as "edge portion") and an inner portion located inside of the portion affixed with the coil 103 (this inner portion is hereinafter referred to as "center portion"). The edge portion is provided with a convex portion 201 (located at an portion surrounded by dotted lines in FIG. 1B) which has a protruding shape in cross section and surrounds the portion affixed with the coil 103. Furthermore, the center portion is provided with ribs 202 extending along the short-diameter direction of the coil 103. With these ribs, the rigidity at the center of the diaphragm 104 in the short-diameter direction can be improved.

Figure 1C:
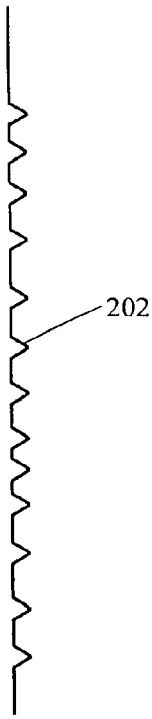

FIG. 1C is a A–A' cross section view of the center portion of the diaphragm 104 illustrated in FIG. 1B. As illustrated in FIG. 1C, one or more ribs (thirteen, in FIG. 1C) are provided in Embodiment 1, being differently spaced apart from each other in the long-diameter direction. In the present embodiment, the ribs have the same height. Alternatively, the ribs can have different heights. In cross section in the A–A' direction, which is perpendicular to a direction to which each rib is oriented (in Embodiment 1, the short-diameter direction), each rib forms an inverted-V-shape, but can form any shape. Other than the portions provided with these ribs, the center portion of the diaphragm 104 is flat in cross section. That is, the center portion of the diaphragm 104 is structured by a flat plate having thereon the ribs integrally formed.

Figure 1D:
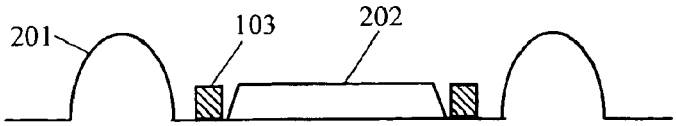

FIG. 1D is a B–B' cross section view of the diaphragm 104 illustrated in FIG. 1B. As illustrated in FIG. 1D, each rib 202 is provided on the same surface (that is, each rib 202 protrudes from the same surface) to which the coil 103 is affixed and from which the convex portion 201 protrudes. The ribs 202 are lower in height than the convex portion 201, and are approximately equal in height to the coil 103. Therefore, when the diaphragm 104 according to Embodiment 1 is designed to be used for a loudspeaker, the thickness of the center portion of the diaphragm 104 does not have to be particularly taken into consideration. Thus, the loudspeaker can be made thinner compared with a case where the center portion is shaped like a dome.

The convex portion 201 has a protruding shape in cross section. Specifically, although shaped like a semi-circle in cross section in Embodiment 1, the convex portion 201 can be shaped like another shape, such as a wavy shape or an oval shape. Furthermore, in cross section in the B–B' direction to which each rib is oriented (in Embodiment 1, the short-diameter direction), the rib 202 is shaped in a trapezoid. Alternatively, the rib 202 can have another shape, such as a semi-circle, an inverted-V-shape, or an oval. Also, the side on which the ribs 202 are provided can be a side from which the convex portion 201 protrudes (an upper side in FIG. 1D), or can be a side opposite thereto (a lower side in FIG. 1D).

The operation and effect of the above-structured loudspeaker is described below. With the above-mentioned structure, a magnetic field is formed by the first and second magnets 101 and 102 and the first and second yokes 109 and 110. The coil 103 is placed so that a maximum magnetic flux density is obtained in a magnetic gap G (refer to FIG. 1A). An alternating current electric signal supplied to the coil 103 produces a driving force. With the produced driving force, the coil 103 and the diaphragm 104 affixed therewith are vibrated, thereby producing sound.

When the diaphragm 104 is vibrated, the rigidity of the diaphragm 104 in the long-diameter direction is maintained by the coil 103. The rigidity thereof in the short-diameter direction, on the other hand, would be lower than that in the long-diameter direction if the ribs 202 had not been provided, because the coil 103 is shaped in a rectangle. However, with the ribs 202 being provided in the short-diameter direction, the rigidity of the diaphragm 104 in the short-diameter direction is improved. Consequently, a vibration mode occurring in the short-diameter direction is suppressed, thereby increasing an upper limiting frequency.

FIG. 2 illustrates sound frequency characteristics in a case where the ribs 202 are provided and in a case where the ribs 202 are not provided. As illustrated in FIG. 2, with the ribs 202 being provided, the upper limiting frequency is improved to be 10 kHz, which is higher than an upper limiting frequency in the case where the ribs 202 are not provided(in that case, approximately 4.5 kHz in FIG. 2). As such, with the ribs 202 being provided on the center portion of the diaphragm 104, the rigidity of the center portion in the short-diameter direction can be improved without forming the center portion to be in a dome-like shape or providing a voice coil bobbin to the center portion.

As described above, according to Embodiment 1, the rigidity of the center portion of the diaphragm 104 can be maintained by the ribs 202. Therefore, sound reproduction in high frequencies can be ensured. Furthermore, with the use of the ribs 202, the thickness of the center portion of the diaphragm 104 can be reduced, compared with conventional diaphragms. Therefore, according to Embodiment 1, it is possible to slim down the loudspeaker itself while maintaining the quality of sound.

In Embodiment 1, the diaphragm 104 and the coil 103 are each shaped like a rectangle when viewed from above. In another embodiment, the diaphragm 104 and the coil 103 each can be in a shape, such as a square, with a side in a longitudinal direction being equal to a side in a horizontal direction, when viewed from above. Even in such a shape of the diaphragm 104, the rigidity can be increased by providing one or more ribs to the center portion. Furthermore, the diaphragm 104 and the coil 103 each can be shaped like an oval. Still further, the diaphragm 104 and the coil 103 are not required to have the same shape.

In Embodiment 1, the rigidity is improved by providing the ribs 202 to the center portion of the diaphragm 104. Alternatively, the rigidity can be improved by increasing the thickness of the diaphragm 104 through, for example, a scheme capable of changing the thickness of the diaphragm in certain areas or a scheme of adding a film. FIG. 2 also illustrates sound frequency characteristics in a case where the thickness of the center portion is made twice as thick as the thickness of the other portions (for example, the convex portion 201). As illustrated in FIG. 2, with the thickness of the center portion being doubled, the upper limiting frequency is improved to be 7 kHz, compared with a case where the thickness is not changed (which is same as the case where the ribs 202 are not provided; approximately 4.5 kHz) As such, by increasing the thickness of the center portion more than that of the other portions, the sound quality can also be maintained, to some extent. Also, with this structure, the loudspeaker can be slimmed down. In this scheme of increasing the thickness of the center portion, as the thickness is increased more, the rigidity can be improved more. Note that, however, as the thickness is increased more, the weight of the diaphragm is also increased, thereby reducing the sound pressure level.

Figure 3:
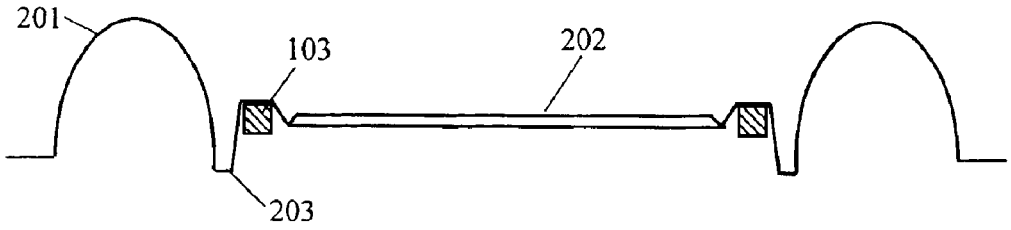
FIG. 3 is a cross section view of a diaphragm according to a modification example of Embodiment 1.
Figure 4:
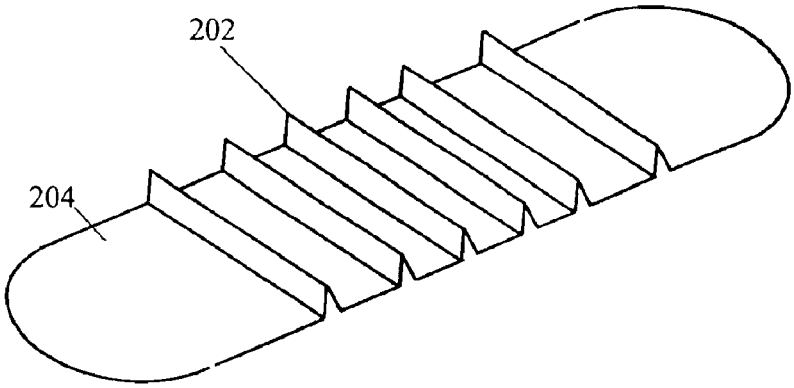
FIG. 4 is an illustration showing one example of a member including ribs 202 when the ribs 202 are formed separately from a diaphragm 104.

FIG. 3 is a section view of the diaphragm according to a modification example of Embodiment 1. In Embodiment 1, the bottom plane of the convex portion 201 coincides with the bottom plane of the ribs 202 (refer to FIG. 1D). In the modification example, both of the bottom planes do not have to coincide with each other. Also, in FIG. 3, a fixing rib 203 is provided along the outer rim of the portion affixed with the coil 103. The fixing rib 203 is formed so as to project from the surface where the coil 103 is affixed. With the fixing rib 203, the coil 103 can be stably affixed to the diaphragm. Furthermore, when the coil 103 is affixed to the diaphragm with an adhesive, the fixing rib 203 can prevent the adhesive from flowing toward the convex portion 201. Note that the fixing rib 203 is provided to at least part of a portion along an outer rim of the coil 103 on the edge portion. Also, the fixing rib 203 can have any shape as long as it protrudes from In Embodiment 1, the diaphragm 104 can be formed integrally with the ribs 202 and other portions, or can be formed separately from the ribs 202. FIG. 4 is an illustration showing one example of a member including the ribs 202 which is formed separately from the diaphragm 104. A member 204 illustrated in FIG. 4 is affixed to the diaphragm 104 whose center portion is flat in cross section, thereby forming the diaphragm 104 having the ribs 202 on the center portion.

Figure 5A:
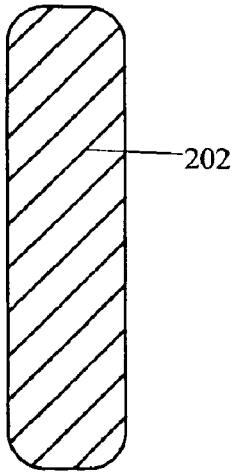
FIGS. 5A and 5B are illustrations showing a center portion of the diaphragm 104 according to modification examples of Embodiment 1.
Figure 5B:
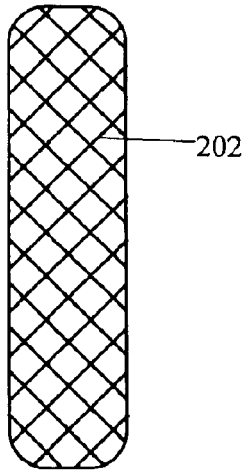

Furthermore, in Embodiment 1, the ribs 202 are provided so as to extend in the short-diameter direction on the diaphragm 104. In modification examples, the direction in which the ribs 202 are provided is not restricted to the above. When the shape of the coil viewed from above has different sides in longitudinal and horizontal directions, the ribs 202 are provided so as to extend in a direction including a component of the short-diameter direction, thereby improving the rigidity in the short-diameter direction. FIGS. 5A and 5B are illustrations showing the center portion of the diaphragm 104 in modification examples. As illustrated in FIG. 5A, the ribs 202 can be provided at a predetermined angle (45 degrees, in FIG. 5A) with respect to the short-diameter direction. Alternatively, as illustrated in FIG. 5B, the ribs 202 can be provided so as to form a lattice shape at a predetermined angle with respect to the short-diameter angle.

Figure 6A:
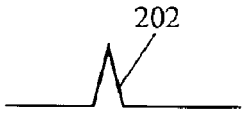
FIGS. 6A and 6B are cross section views of each rib 202.
Figure 6B:
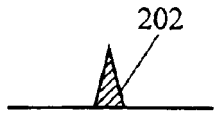

FIGS. 6A and 6B are cross section views of each rib 202. Each rib can be hollow as illustrated in FIG. 6A, or can be dense with a substance (unhollow).

(Embodiment 2)

Figure 7A:
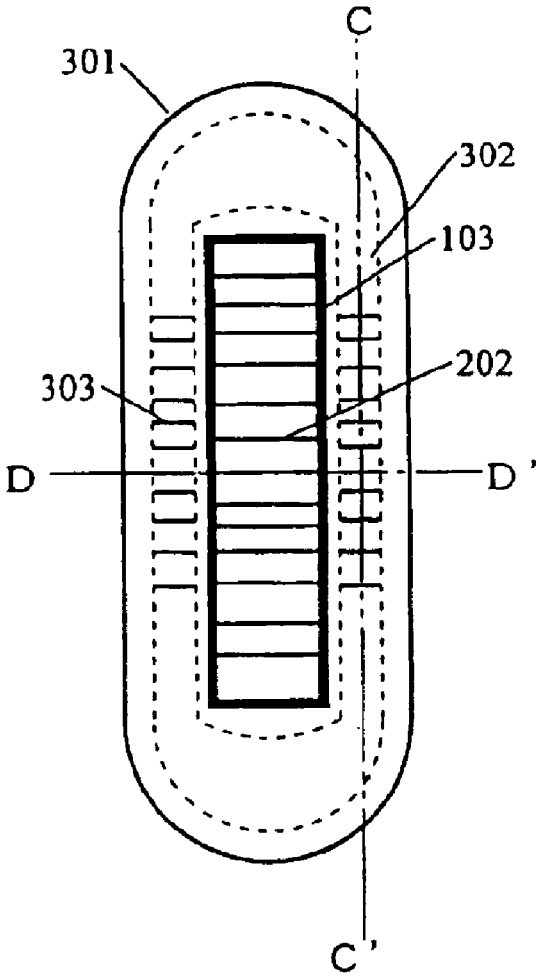
FIGS. 7A through 7C are illustrations showing a diaphragm according to Embodiment 2.
Figure 7B:
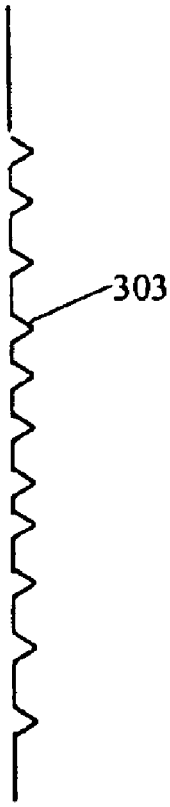
Figure 7C:
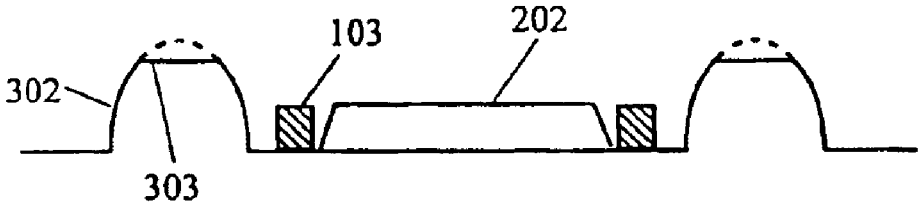
Figure 8:
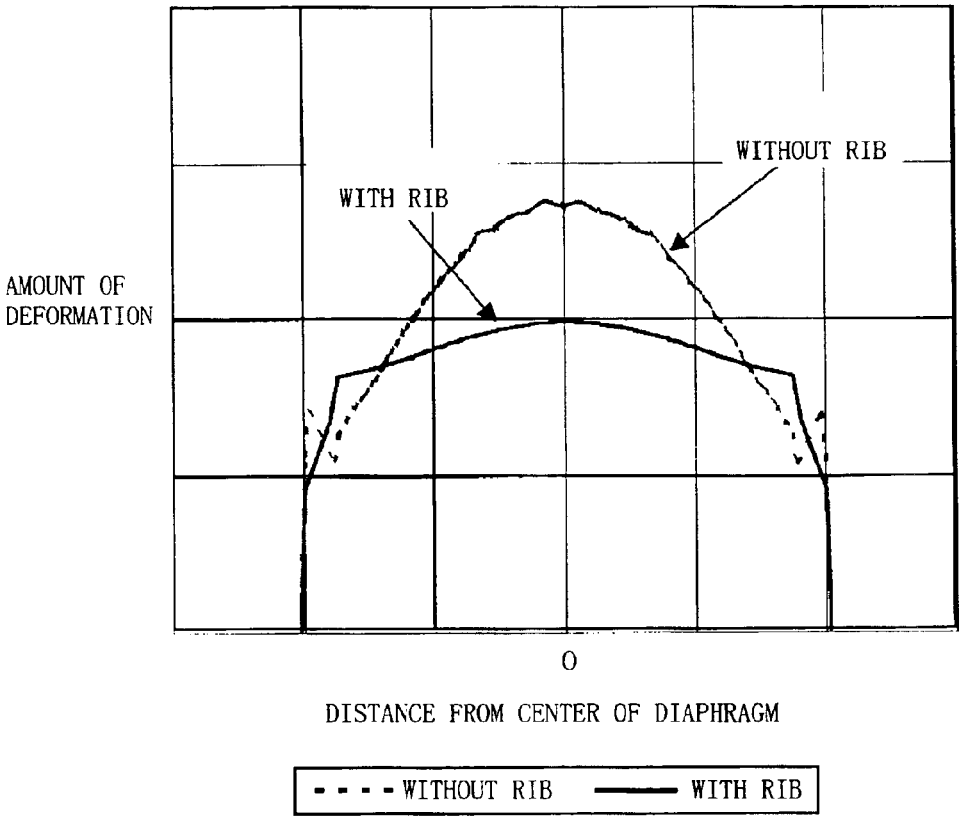
FIG. 8 is a graph showing vibration modes of the diaphragm according to Embodiment 2.

A diaphragm according to Embodiment 2 of the present invention is described below with reference to FIGS. 7A through 7C and FIG. 8. FIGS. 7A through 7C are illustrations showing the diaphragm according to Embodiment 2. FIG. 8 is an illustration showing vibration modes of the diaphragm according to Embodiment 2. As with Embodiment 1, the diaphragm according to Embodiment 2 is used as being connected to a loudspeaker, although not shown. Furthermore, in Embodiment 2, the components identical to those in Embodiment 1 are provided with the same reference numerals.

FIG. 7A is a top plan view of the diaphragm according to Embodiment 2. As illustrated in FIG. 7A, the diaphragm 301 is shaped so as to extend in the longitudinal direction in FIG. 7A. That is, as with the diaphragm 104, the diaphragm 301 has a shape having different lengths in the longitudinal direction and the horizontal direction.

The diaphragm 301 is different from the diaphragm 104 in that ribs 303 are provided on the convex portion 302. As illustrated in FIG. 7A, the ribs 303 are provided on portions of the convex portion 302 that are oriented in the long-diameter direction (the longitudinal direction in FIG. 7A). Also, the ribs 303 are provided so as to extend along the short-diameter direction (the horizontal direction in FIG. 7A). The center portion and other portions of the diaphragm 301 are identical to those of the diaphragm 104.

FIG. 7B is a C–C' cross section view of the diaphragm 301 illustrated in FIG. 7A. In FIG. 7B, only the portion provided with the ribs 303 are illustrated. As illustrated in FIG. 7B, one or more ribs (eleven, in FIG. 1B) are provided in Embodiment 2, being differently spaced apart from each other in the long-diameter direction. In the present embodiment, the ribs have the same depth. In cross section, each rib forms a V-shape, but can form any shape.

FIG. 7C is a D–D' cross section view of the diaphragm 301 illustrated in FIG. 7A. In FIG. 7C, portions like semi-ovals drawn by dotted curved lines represent the surface of the convex portion 302. The cord of each semi-oval represented by a solid line represents a lower side of each rib 303 forming the tip of the V-shape. That is, each rib 303 is provided so as to have a predetermined depth from the top of the assumed surface of the semi-oval convex portion 302. Other than the rib 303 being provided, FIG. 7C is similar to FIG. 1D.

As described above, with the ribs 303 being provided on the convex portion 302, the elasticity of the convex portion 302 can be changed. Specifically, with the ribs 303 being provided to a portion on the convex portion 302 closer to the center of the diaphragm 301, the elasticity of the convex portion 302 can be increased.

FIG. 8 is a graph showing vibration modes of the diaphragm with respect to the long-diameter direction at the time of producing sound of 250 Hz. Illustrated in FIG. 8 are vibration modes of the diaphragm 301 provided with the ribs 303 on the convex portion 302 (represented as "with rib" in FIG. 8) and those of a diaphragm 301 without ribs (represented as "without rib" in FIG. 8).

As illustrated in FIG. 8, as for the diaphragm without ribs on the convex portion, there is a large difference in the amount of deformation between the vicinity of the center of the diaphragm and both ends (in the long-diameter direction) of the diaphragm. This is because, without ribs on the convex portion, the elasticity of the convex portion in the vicinity of the center of the diaphragm is not balanced with the elasticity thereof far away from the center of the diaphragm. That is, in the vicinity of the center of the diaphragm, the elasticity of the convex portion is small, and therefore the amount of deformation therein is large. At both ends of the diaphragm, on the other hand, the elasticity of the convex portion is large, and therefore the amount of deformation at those ends is small. For this reason, the diaphragm is vibrated in a mode totally different from the ideal piston motion, thereby even affecting sound pressure frequency characteristics.

By contrast, as for the diaphragm 301, the difference in the amount of deformation between the vicinity of the center of diaphragm and both ends thereof is small. This is because, with the ribs 303 being provided on the convex portion 302, the balance in elasticity of the convex portion between the vicinity of the center of the diaphragm and portions far away from the center portion is improved. That is, in the vicinity of the center of the diaphragm, the elasticity of the convex portion 302 is increased by the ribs 303, thereby suppressing the amount of deformation. Consequently, the entire diaphragm 301 can be vibrated in a mode similar to the piston motion, thereby improving the sound pressure frequency characteristics.

As described above, according to Embodiment 2, with the ribs being provided on the convex portion, the elasticity of the entire convex portion can be balanced even when the diaphragm has a shape having different lengths in the longitudinal direction and the horizontal direction. This leads to an improvement in sound quality. Furthermore, as illustrated in FIG. 8, the amount of deformation of the center of the diaphragm can be suppressed. Therefore, components of the loudspeaker, such as the first and second magnets 101 and 102 illustrated in FIG. 1A, can be placed closer to the diaphragm. That is, the loudspeaker can be slimmed down.

Figure 9:
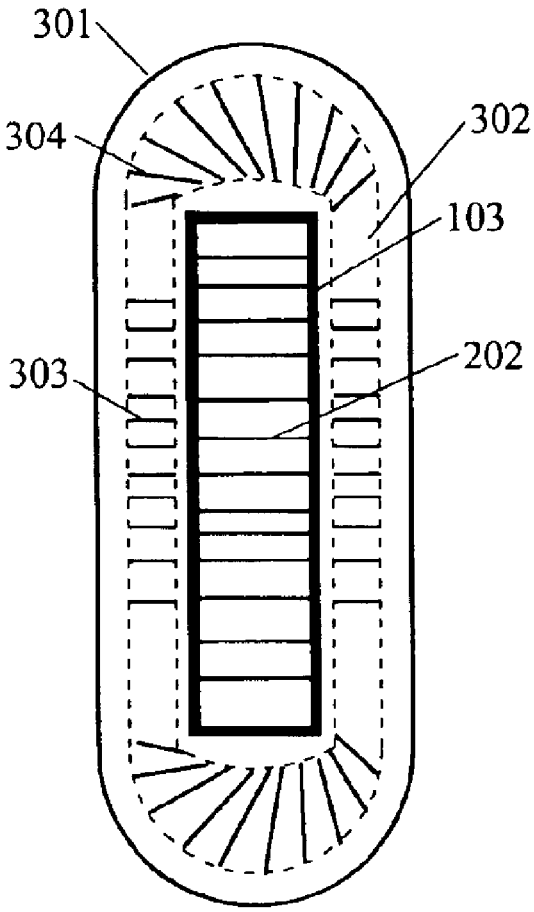
FIG. 9 is a plan view of a diaphragm according to a modification example of Embodiment 2.

In modification examples of Embodiment 2, the convex portion 302 is further provided with one or more tangential ribs. FIG. 9 is a top plan view of a diaphragm according to one modification example. As illustrated in FIG. 9, tangential ribs 304 are provided on portions located at both ends of the convex portion 302 in the long-diameter direction. Those tangential ribs extend so as to be differently oriented from each other. As such, with the tangential ribs 304 being provided on the portions located far away from the center of the diaphragm, the elasticity of those portions can be reduced. Thus, it is possible to further improve the balance in elasticity of the convex portion 302. As described above, in the modification example, with the tangential ribs added together with the ribs, the elasticity of the entire convex portion 302 can be adjusted.

In Embodiment 2, the height of the convex portion 302 is constant at any portion. Alternatively, by partially changing the height, the elasticity of the convex portion 302 can be adjusted. Specifically, of the convex portion 302, the height of a portion closer to the center of the diaphragm is made higher, while the height of a portion far away from the center thereof is made lower. With this, it is also possible to adjust the elasticity of the entire convex portion 302.

Furthermore, as with Embodiment 1, a fixing rib (refer to FIG. 3) can be provided to the diaphragm of Embodiment 2. With such a fixing rib being provided, as with Embodiment 1, the coil can be stably affixed to the diaphragm. Still further, when the coil 103 is affixed to the diaphragm with an adhesive, the fixing rib 203 can prevent the adhesive from flowing toward the convex portion 201.

In Embodiments 1 and 2, the coil 103 is implemented by a winding coil. Alternatively, by way of example, a print coil can be used, which is obtained through printing by etching the diaphragm (made from polyimide, for example) coated in advance with copper. Also, the coil 103 can be shaped like an oval.

Furthermore, in Embodiments 1 and 2, the diaphragm 104 and the coil 103 are formed by affixing the coil 103 to the diaphragm 104 that have been formed integrally with the ribs. Alternatively, the diaphragm 104 can be molded after the coil 103 is affixed to the diaphragm 104. This is preferable particularly when the above-mentioned print coil is used. Still further, in Embodiments 1 and 2, the coil 103 is affixed on one side of the diaphragm 104. Alternatively, two coils 103 can be affixed on both sides of the diaphragm 104.

The material of the diaphragm according to Embodiment 1 or 2 can be, for example, PEI (polyetherimido), paper, or PEN (polyethylene naphthalate), depending on characteristics sought to be obtained.

Still further, the edge portion is provided with the convex portion in Embodiments 1 and 2, but may not be provided with the convex portion. That is, the edge portion may be flat in cross section. In this case, the ribs 303 in Embodiment 2 are also provided at locations similar to those provided when the convex portion is provided.

Still further, in Embodiments 1 and 2, descriptions have been made to the diaphragm according to the present invention are used for a loudspeaker whose two magnets sandwich the diaphragm. Alternatively, the diaphragm according to the present invention can be used for another loudspeaker typified by a loudspeaker having a magnetic circuit of another type, such as an outer- or inner-magnet type, or a loudspeaker of a driving type. Still further, a loudspeaker using the diaphragm according to the present invention can be easily slimmed down. Therefore, such a loudspeaker can be effectively used for an electronic device, such as a cellular phone or a PDA.

Figure 10:
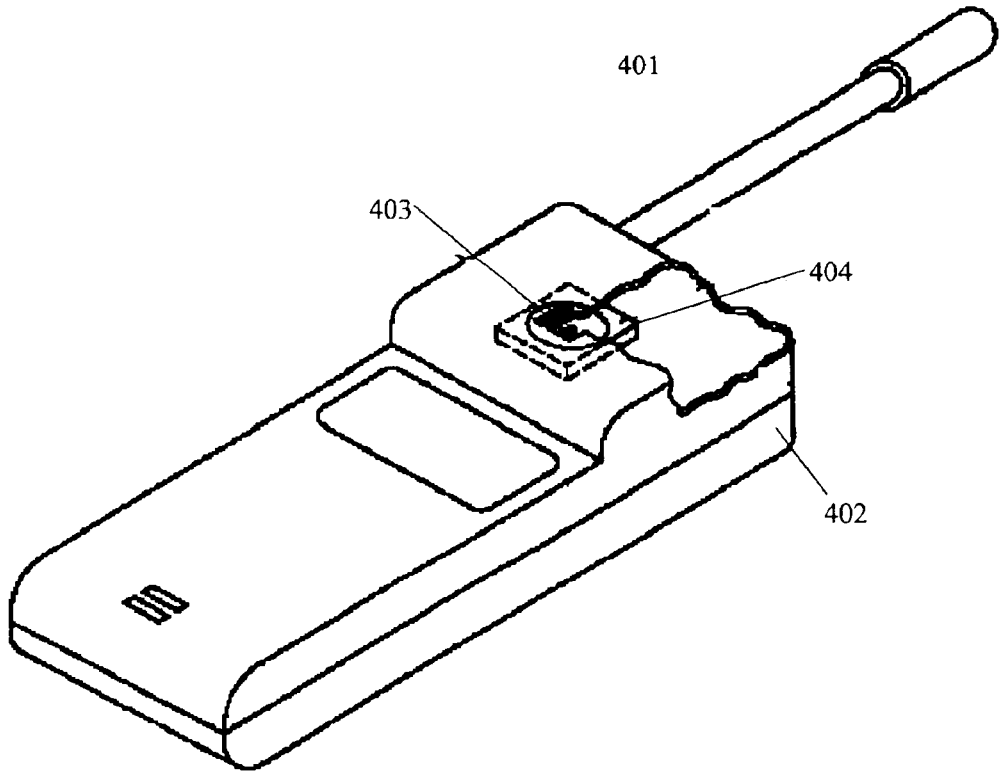
FIG. 10 is a cut away view of a cellular phone incorporated with the loudspeaker using the diaphragm according to Embodiment 1 or 2.
Figure 11:
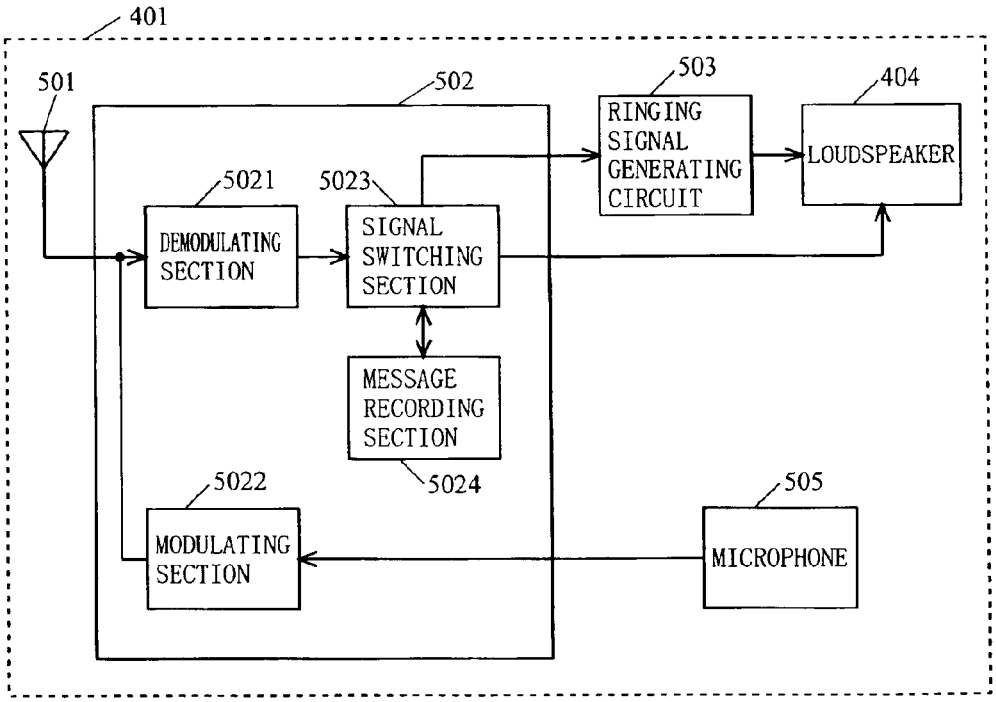
FIG. 11 is a block diagram showing an outline of the configuration of the cellular phone incorporated with the loudspeaker using the diaphragm according to Embodiment 1 or 2.
Figure 12A:
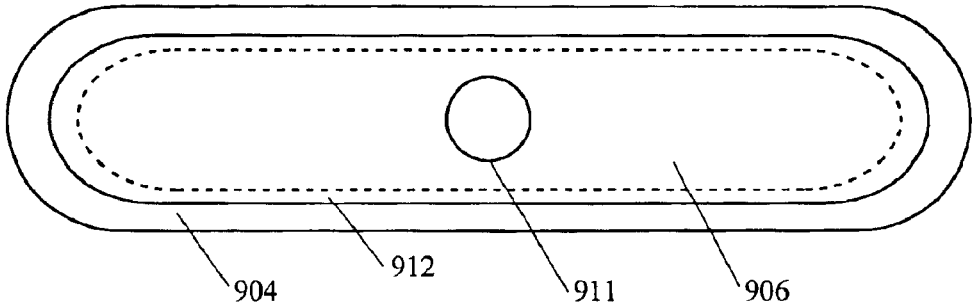
FIG. 12A PRIOR ART
FIGS. 12A and 12B are illustrations showing the structure of a conventional slim loudspeaker.
Figure 12B:
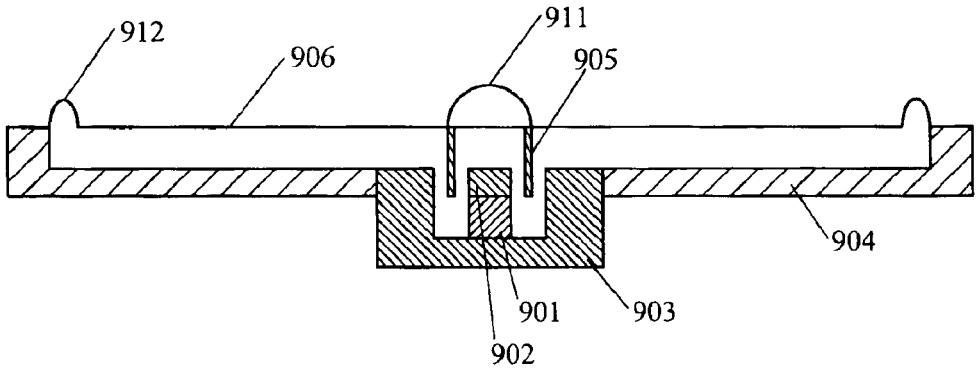
FIG. 12B PRIOR ART

Descriptions are now made to a cellular phone, which is one example of an electronic device incorporated with a loudspeaker using the diaphragm of Embodiment 1 or 2. FIG. 10 is a cutaway view of the cellular phone 401. FIG. 11 is an illustration showing an outline of the configuration of the cellular phone.

In FIG. 10, a cellular phone 401 includes a housing 402, a sound aperture 403 provided on the housing 402, and a loudspeaker 404 using the diaphragm of Embodiments 1 or 2. The diaphragm of the loudspeaker 404 is provided so as to be opposed to the sound aperture 403 inside the housing 402.

In FIG. 11, the cellular phone 401 includes an antenna 501, a transmitting and receiving circuit 502, a ringing signal generating circuit 503, the loudspeaker 404, and a microphone 505. The transmitting and receiving circuit 502 includes a demodulating section 5021, a modulating section 5022, a signal switching section 5023, and a message recording section 5024.

The antenna 501 receives a modulated electric wave output from the nearest base station. The demodulating section 5021 demodulates the modulated wave supplied from the antenna 501 to a receive signal for supply to the signal switching section 5023. The signal switching section 5023 is a circuit for switching signal processing in accordance with the receive signal. That is, if the receive signal is a call signal, the receive signal is given to the ringing signal generating circuit 503. If the receive signal is a voice signal, the receive signal is given to the loudspeaker 404. If the receive signal is a voice signal representing a message to be recorded, the receive signal is given to the message recording section 5024. The message recording section 5024 is implemented typically by a semiconductor memory. When the power is ON, the message is recorded in the message recording section 5024. When the cellular phone is located outside of a service area or the power is OFF, the message is stored in a recording device at the base station. The ringing signal generating circuit 503 generates a ringing signal for supply to the loudspeaker 404.

As with conventional cellular phones, the small-sized microphone 505 is provided. The modulating section 5022 is a circuit for modulating a dial signal or a voice signal converted by the microphone 505 for output to the antenna 501.

The operation of the above-structured cellular phone is described below. An electric wave output from the base station is received by the antenna 501, and is then demodulated by the demodulating section 5021 to a baseband receive signal. Upon detection of a ringing signal in the incoming call signal, the signal switching section 5023 outputs the incoming call signal to the ringing signal generating circuit 503 in order to notify the cellular phone user of the incoming call.

Upon reception of the incoming call signal, the ringing signal generating circuit 503 outputs a ringing signal of simple tone or complex tone in an audible frequency band. The user hears ringing sounds produced from the loudspeaker 404 through the sound aperture 403 to know the incoming call.

When the user enters an off-hook mode, the signal switching section 5023 adjusts the level of the receive signal, and then outputs the voice signal directly to the loudspeaker 404. The loudspeaker 404 then serves as a receiver or a loudspeaker to reproduce voice signals.

The user's voice is collected by the microphone 505, converted to an electric signal, and is then supplied to the modulating section 5022. The voice signal is modulated with a predetermined carrier for output from the antenna 501.

If the cellular phone user has turned the power ON and set an answering function ON, a message is recorded in the message recording section 5024. If the user has turned the power OFF, the message is temporarily stored in the base station. When the user requests for replay of the message through key operations, the signal switching section 5023 responds to this request to obtain the message recorded in the message recording section 5024 or the base station. The signal switching section 5023 adjusts the obtained voice signal to an audible level for output to the loudspeaker 404. The loudspeaker 404 then serves as a receiver or a loudspeaker to output the message.

In the above example, the loudspeaker is directly mounted on the housing. Alternatively, the loudspeaker can be mounted on a board incorporated in the cellular phone. Still alternatively, the loudspeaker can be mounted to another type of electronic device to achieve operations and effects similar to those above.

While the invention has been described in detail, the foregoing description is in all aspects illustrative and not restrictive. It is understood that numerous other modifications and variations can be devised without departing from the scope of the invention.

What is claimed is:

1. A loudspeaker diaphragm having a portion affixed with a coil, the loudspeaker diaphragm comprising:

an edge portion located outside of the portion affixed with the coil; and a center portion located inside of the portion affixed with the coil;

wherein the center portion is provided with a rib, wherein the edge portion has a convex portion having a protruding shape in cross section, and wherein the rib has a height lower than a height of the edge portion in cross section.

2. The loudspeaker diaphragm according to claim 1, wherein the coil is shaped so as to extend along a first direction, and a direction in which the rib is provided includes a component of a second direction perpendicular to the first direction.

3. The loudspeaker diaphragm according to claim 2, wherein the rib is provided so as to extend along the second direction.

4. The loudspeaker diaphragm according to claim 2, wherein a plurality of said ribs are provided to form a lattice shape at a predetermined angle with respect to the first direction.

5. The loudspeaker diaphragm according to claim 1, wherein the rib is provided on a side of the portion affixed with the coil, and has a height lower than a height of the coil.

6. The loudspeaker diaphragm according to claim 1, wherein the rib is formed integrally with the center portion.

7. The loudspeaker diaphragm according to claim 1, wherein the rib is attached to the center portion.

8. The loudspeaker diaphragm according to claim 1, wherein the coil is shaped so as to extend along a first direction, the edge portion is shaped so as to have an elasticity in the first direction equal to an elasticity in a second direction perpendicular to the first direction, and the edge portion is shaped so as to extend along the first direction.

9. The loudspeaker diaphragm according to claim 1, wherein the coil is a printing voice coil formed integrally with the loudspeaker diaphragm.

10. The loudspeaker diaphragm according to claim 1, wherein the loudspeaker diaphragm is molded after being formed integrally with the coil affixed thereto.

11. The loudspeaker diaphragm according to claim 1, wherein at least part of a portion along an outer rim of the coil on the edge portion protrudes from a side of the portion affixed with the coil.

12. A loudspeaker comprising:

the loudspeaker diaphragm according to claim 1;

a housing supporting the loudspeaker diaphragm;

a voice coil affixed to the loudspeaker diaphragm; and a magnetic circuit.

13. The loudspeaker according to claim 12, wherein the magnetic circuit includes at least two magnets placed at both sides with respect to a vibrating direction of the loudspeaker diaphragm so as to sandwich the voice coil.

14. An electronic device comprising:

the loudspeaker according to claim 13; and a supporting housing supporting the loudspeaker inside thereof.

15. The loudspeaker according to claim 12, wherein the magnetic circuit includes at least two magnets placed at both sides with respect to a vibrating direction of the loudspeaker diaphragm so as to sandwich the voice coil.

16. An electronic device comprising:

the loudspeaker according to claim 15; and a supporting housing supporting the loudspeaker inside thereof.

17. An electronic device comprising:

the loudspeaker according to claim 12; and a supporting housing supporting the loudspeaker inside thereof.

18. A loudspeaker diaphragm having a portion affixed with a coil, the loudspeaker diaphragm comprising:

an edge portion located outside of the portion affixed with the coil; and a center portion located inside of the portion affixed with the coil, wherein the edge portion is formed integrally with the center portion, and wherein the center portion is provided with a strengthening portion which is flat in cross section and is thicker than the edge portion.

19. A loudspeaker diaphragm extending along a first direction, wherein a coil is affixed to a portion of the loudspeaker diaphragm and extends along the first direction, the loudspeaker diaphragm comprising:

an edge portion located outside of the portion affixed with the coil; and a center portion located inside of the portion affixed with the coil, wherein the edge portion has a shape so that an elasticity at a portion thereof close to a center of the diaphragm with respect to the first direction is larger than an elasticity at a portion thereof far away from the center of the diaphragm.

20. The loudspeaker diaphragm according to claim 19, wherein the edge portion includes a convex portion having a protruding shape in cross section and annularly surrounding the portion affixed with the coil, and a height of a portion of the convex portion that is oriented in the first direction is higher than a height of a portion of the convex portion that is oriented in a second direction perpendicular to the first direction.

21. The loudspeaker diaphragm according to claim 19, wherein portions on the edge portion which are located on both sides of the coil with respect to a center axis of the coil in the first direction are each provided with a rib extending approximately in parallel with a second direction perpendicular to the first direction.

22. The loudspeaker diaphragm according to claim 19, wherein the coil is a printing voice coil formed integrally with the loudspeaker diaphragm.

23. The loudspeaker diaphragm according to claim 19, wherein the loudspeaker diaphragm is molded after being formed integrally with the coil affixed thereto.

24. The loudspeaker diaphragm according to claim 19, wherein at least part of a portion along an outer rim of the coil on the edge portion protrudes from a side of the portion affixed with the coil.

25. A loudspeaker comprising:

the loudspeaker diaphragm according to claim 19;

a housing supporting the loudspeaker diaphragm;

a voice coil affixed to the loudspeaker diaphragm; and a magnetic circuit.

26. The loudspeaker according to claim 25, wherein the magnetic circuit includes at least two magnets placed at both sides with respect to a vibrating direction of the loudspeaker diaphragm so as to sandwich the voice coil.

27. An electronic device comprising:

the loudspeaker according to claim 26; and a supporting housing supporting the loudspeaker inside thereof.

28. The loudspeaker according to claim 25;

wherein the magnetic circuit includes at least two magnets placed at both sides with respect to a vibrating direction of the loudspeaker diaphragm so as to sandwich the voice coil.

29. An electronic device comprising:

the loudspeaker according to claim 28; and a supporting housing supporting the loudspeaker inside thereof.

30. An electronic device comprising:

the loudspeaker according to claim 25; and a supporting housing supporting the loudspeaker inside thereof.

* * * * *

UNITED STATES PATENT AND TRADEMARK OFFICE

CERTIFICATE OF CORRECTION

PATENT NO. : 6,920,957 B2
DATED : July 26, 2005
INVENTOR(S) : Sawako Usuki et al.

It is certified that error appears in the above-identified patent and that said Letters Patent is hereby corrected as shown below:

Title page,
Item [56], References Cited, FOREIGN PATENT DOCUMENTS, please replace "7/1988" with -- 7/1998 --.

Column 14,
Line 51, please replace "claim 25;" with -- claim 25, --.

Signed and Sealed this

Twenty-ninth Day of November, 2005

JON W. DUDAS
*Director of the United States Patent and Trademark Office*